US010390147B2

(12) United States Patent
Van Der Werf

(10) Patent No.: US 10,390,147 B2
(45) Date of Patent: Aug. 20, 2019

(54) FREQUENCY MAPPING FOR HEARING DEVICES

(71) Applicant: GN Hearing A/S, Ballerup (DK)

(72) Inventor: Erik Cornelis Diederik Van Der Werf, Eindhoven (NL)

(73) Assignee: GN Hearing A/S, Ballerup (DK)

( * ) Notice: Subject to any disclaimer, the term of this patent is extended or adjusted under 35 U.S.C. 154(b) by 594 days.

(21) Appl. No.: 14/630,484

(22) Filed: Feb. 24, 2015

(65) Prior Publication Data

US 2016/0249138 A1 Aug. 25, 2016

(51) Int. Cl.
*H04R 25/00* (2006.01)

(52) U.S. Cl.
CPC ..... *H04R 25/353* (2013.01); *H04R 25/356* (2013.01); *H04R 25/505* (2013.01); *H04R 25/552* (2013.01); *H04R 2225/021* (2013.01); *H04R 2225/023* (2013.01); *H04R 2225/025* (2013.01)

(58) Field of Classification Search
CPC .... H04R 25/353; H04R 25/505; H04R 25/48; H04R 2225/023; H04R 2225/021; H04R 25/552; H04R 2225/025; H04R 25/356; H04R 2225/43; H04R 2430/03
USPC ..... 381/312, 316, 318, 320, 321, 328, 330, 381/106; 704/203, 500
See application file for complete search history.

(56) References Cited

U.S. PATENT DOCUMENTS 4,464,784 A * 8/1984 Agnello ..... G10L 21/04 381/61
5,394,475 A * 2/1995 Ribic ..... H03G 7/002 381/106
6,049,617 A * 4/2000 Sigwanz ..... H03G 3/3089 381/312
6,240,195 B1 * 5/2001 Bindner ..... H04R 25/353 375/372
6,577,739 B1 * 6/2003 Hurtig ..... H04R 25/353 381/106
6,606,391 B2 * 8/2003 Brennan ..... H03H 17/0266 381/312
7,248,711 B2 * 7/2007 Allegro ..... H04R 25/353 381/316
7,333,930 B2 * 2/2008 Baumgarte ..... G10L 19/032 704/200.1
7,580,536 B2 * 8/2009 Carlile ..... G10L 21/00 381/316

(Continued)

OTHER PUBLICATIONS

Richard G. Lyons, How to Interpolate in the Time-Domain by Zero-Padding in the Frequency Domain, dated 1999, published by Iowegian International.*

*Primary Examiner* — Huyen D Le

(74) *Attorney, Agent, or Firm* — Vista IP Law Group, LLP

(57) ABSTRACT

A hearing device includes: a microphone for reception of sound and conversion of the received sound into a corresponding first audio signal; a processing unit for providing a second audio signal compensating a hearing loss of a user of the hearing aid based on the first audio signal; and a receiver for providing an output sound signal based on the second audio signal; wherein the processing unit comprises a band splitter, a pitch shifter, and a frequency shifter, and wherein the pitch shifter and the frequency shifter are arranged in a first channel for performing frequency mapping.

55 Claims, 10 Drawing Sheets

(56) References Cited

U.S. PATENT DOCUMENTS

| | | | | |
|---|---|---|---|---|
| 8,964,993 | B2 * | 2/2015 | Fairey | H04R 5/04 381/17 |
| 9,060,231 | B2 * | 6/2015 | Fitz | H04R 25/353 |
| 9,319,804 | B2 * | 4/2016 | Allegro-Baumann | G10L 21/0364 |
| 2007/0253585 | A1 * | 11/2007 | Steinbuss | H04R 25/353 381/312 |
| 2007/0269069 | A1 * | 11/2007 | Kornagel | H04R 25/453 381/318 |
| 2011/0004468 | A1 * | 1/2011 | Fusakawa | G10L 21/04 704/214 |
| 2011/0142271 | A1 * | 6/2011 | Tiefenau | H04R 25/353 381/316 |
| 2011/0150256 | A1 * | 6/2011 | Baechler | H04R 25/353 381/316 |
| 2012/0076335 | A1 * | 3/2012 | Bauml | H04R 25/353 381/320 |
| 2013/0202119 | A1 * | 8/2013 | Thiede | A61B 5/0482 381/23.1 |
| 2015/0333717 | A1 * | 11/2015 | Pontoppidan | H03G 3/00 704/258 |

* cited by examiner

REPLACEMENT SHEET

4 / 10

Test signal (input)

FREQUENCY MAPPING FOR HEARING DEVICES

FIELD

This application relates generally to hearing devices, and more specifically, to hearing devices with frequency mapping.

BACKGROUND

Hearing loss may cause some frequencies to be inaudible. When ordinary amplification alone becomes insufficient, audibility can be restored by mapping inaudible frequencies to a different (audible) location of the spectrum.

SUMMARY

New digital signal processing solutions that restores audibility by mapping inaudible frequencies to a different (audible) location of the spectrum are disclosed herein. In particular, frequency mapping techniques for hearing devices are described herein. As used in this specification, the term "frequency mapping" refers to any signal processing to obtain a desired frequency or frequencies. In accordance with some embodiments, frequency mapping may be performed in the time domain using three transforms (or mappings): (1) band split, which divides an input signal into low and high frequencies ($f_{lo}<f_{cutoff}<f_{hi}$), (2) frequency shift, which adjusts frequencies by a constant offset ($f_{out}=f_{in}+\Delta$), and (3) pitch shift, which moves frequencies by a proportional offset ($f_{out}=\alpha f_{in}$).

A hearing device includes: a microphone for reception of sound and conversion of the received sound into a corresponding first audio signal; a processing unit for providing a second audio signal compensating a hearing loss of a user of the hearing aid based on the first audio signal; and a receiver for providing an output sound signal based on the second audio signal; wherein the processing unit comprises a band splitter, a pitch shifter, and a frequency shifter, and wherein the pitch shifter and the frequency shifter are arranged in a first channel for performing frequency mapping.

Optionally, the pitch shifter comprises a resampler.

Optionally, the hearing device further includes a tempo adjuster, wherein the resampler is coupled between the band splitter and the tempo adjuster.

Optionally, the hearing device further includes a tempo adjuster, wherein the tempo adjuster is coupled between the band splitter and the resampler.

Optionally, the frequency shifter comprises a Hilbert transform module for performing a Hilbert transform.

Optionally, the frequency shifter comprises an amplitude modulator and one or more filters coupled to the amplitude modulator.

Optionally, the frequency shifter comprises a FFT transform module.

Optionally, the hearing device further includes a tempo adjuster, wherein the frequency shifter is configured to provide an output signal based on an output from the tempo adjuster.

Optionally, the pitch shifter comprises a resampler, and the frequency shifter is configured to provide an output signal based on an output from the resampler.

Optionally, the pitch shifter comprises a resampler, and the frequency shifter comprises a Hilbert transform module; and wherein the processing unit further includes a tempo adjuster and a phase rotation module.

Optionally, the resampler, the Hilbert transform module, the tempo adjuster, and the phase rotation module are coupled in series according to the following order: (1) the resampler, (2) the tempo adjuster, (3) the Hilbert transform module, and (4) the phase rotation module.

Optionally, the resampler, the Hilbert transform module, the tempo adjuster, and the phase rotation module are coupled in series according to the following order: (1) the tempo adjuster, (2) the resampler, (3) the Hilbert transform module, and (4) the phase rotation module.

Optionally, the resampler, the Hilbert transform module, the tempo adjuster, and the phase rotation module are coupled in series according to the following order: (1) the resampler, (2) the Hilbert transform module, (3) the tempo adjuster, and (4) the phase rotation module.

Optionally, the resampler, the Hilbert transform module, the tempo adjuster, and the phase rotation module are coupled in series according to the following order: (1) the resampler, (2) the Hilbert transform module, (3) the phase rotation, and (4) the tempo adjuster.

Optionally, the resampler, the Hilbert transform module, the tempo adjuster, and the phase rotation module are coupled in series according to the following order: (1) the Hilbert transform module, (2) the phase rotation, (3) the tempo adjuster, and (4) the resampler.

Optionally, the pitch shifter comprises a resampler, and the frequency shifter comprises a first Hilbert transform module; and wherein the processing unit further includes a tempo adjuster, a phase rotation module, and a second Hilbert transform module; and wherein the resampler, the first Hilbert transform module, the second Hilbert transform module, the tempo adjuster, and the phase rotation module are coupled in series according to the following order: (1) the first Hilbert transform module, (2) the tempo adjuster, (3) the resampler, (4) the second Hilbert transform module, and (5) the phase rotation module.

Optionally, the band splitter, the pitch shifter, the frequency shifter, or any combination of the foregoing is configured to perform signal processing in a time domain.

Optionally, the band splitter is configured to provide a first output in the first channel for processing to achieve the first frequency mapping, and a second output in a second channel for processing to achieve a second frequency mapping.

Optionally, the band splitter is configured to provide a first output for processing in the first channel, a second output for processing in a second channel, and a third output for processing in a third channel.

Optionally, the microphone, the processing unit, and the receiver are parts of a behind-the-ear (BTE) hearing aid, an in-the-ear (ITE) hearing aid, an in-the-canal (ITC) hearing aid, or a binaural hearing aid system.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
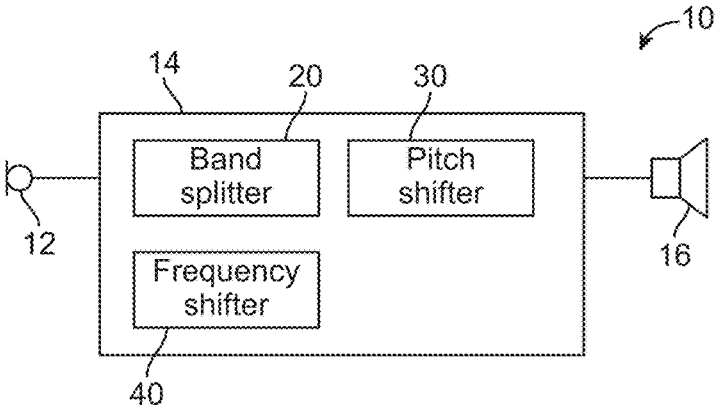
FIG. 1 illustrates a hearing device in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

FIG. 1 illustrates a hearing device 10 in accordance with some embodiments. The hearing device 10 includes: a microphone 12 for reception of sound and conversion of the received sound into a corresponding first audio signal. The hearing device 10 also includes a processing unit 14 for providing a second audio signal compensating a hearing loss of a user of the hearing aid 10 based on the first audio signal. The hearing device 10 also includes a receiver 16 for providing an output sound signal based on the second audio signal. In the illustrated embodiments, the processing unit 14 comprises: a band splitter 20 for providing a first output, a pitch shifter 30 for providing a second output based at least in part on the first output of the band splitter 20, and a frequency shifter 40 for providing a third output based at least in part on the second output of the pitch shifter 30. In some embodiments, the band splitter 20, the pitch shifter 30, the frequency shifter 40, or any combination of the foregoing, may be configured to perform signal processing for frequency mapping in the time domain.

It should be noted that the processing unit 14 should not be limited to having the above components, and may include other components. For example, the processing unit 14 may comprise elements such as amplifiers, compressors, environment classifiers, noise reduction systems, etc. Also, in some cases, the hearing device 10 may furthermore include a transceiver for wireless data communication interconnected with an antenna for emission and reception of an electromagnetic field. The transceiver may connect to the processing unit 14, and may be used for communication with another device, such as with another hearing device located at another ear in a binaural hearing aid system, or with a phone, etc.

The hearing device 10 may be different types of hearing aid in different embodiments. By means of non-limiting examples, the hearing device 10 may be a behind-the-ear hearing aid, an in-the-ear hearing aid, an in-the-canal hearing aid, or any of other types of hearing aid. Also, in other embodiments, the hearing device 10 may be a part of a binaural hearing aid system, which includes an additional hearing device having a similar or same configuration as that of the hearing device 10. During use, the hearing device 10 is placed at a first ear of a user, and the additional hearing device is placed at a second ear of the user. The hearing device 10 and the additional hearing device may communicate with each other to compensate for hearing loss of the user.

In the illustrated embodiments, the band splitter 20 is configured to divide an input spectrum into low and high frequencies. Accordingly, the first output of the band splitter 20 may be low frequency signal(s), high frequency signal(s), or combination of both. The pitch shifter 30 is configured to shift one or more frequencies by a proportional offset. Accordingly, the second output of the pitch shifter 30 is one or more scaled frequencies. The frequency shifter 40 is configured to shift one or more frequencies by a constant offset. Accordingly, the third output of the frequency shifter 40 is one or more shifted frequencies. In some cases, the band splitter 20, the pitch shifter 30, and the frequency shifter 40 are configured to cooperate with each other to provide a piece-wise linear mapping.

In some cases, frequency compression may be achieved using the pitch shifter 30 to perform a pitch down in combination with the frequency shifter 40 to perform a shift up. Also, frequency expansion may be achieved using the pitch shifter 30 to perform a pitch up in combination with the frequency shifter 40 to perform a shift down. The frequency shifting allows alignment of frequencies at the knee-point (cutoff frequency), which avoids ambiguity and prevents distortion of the low frequencies.

Figure 2A:
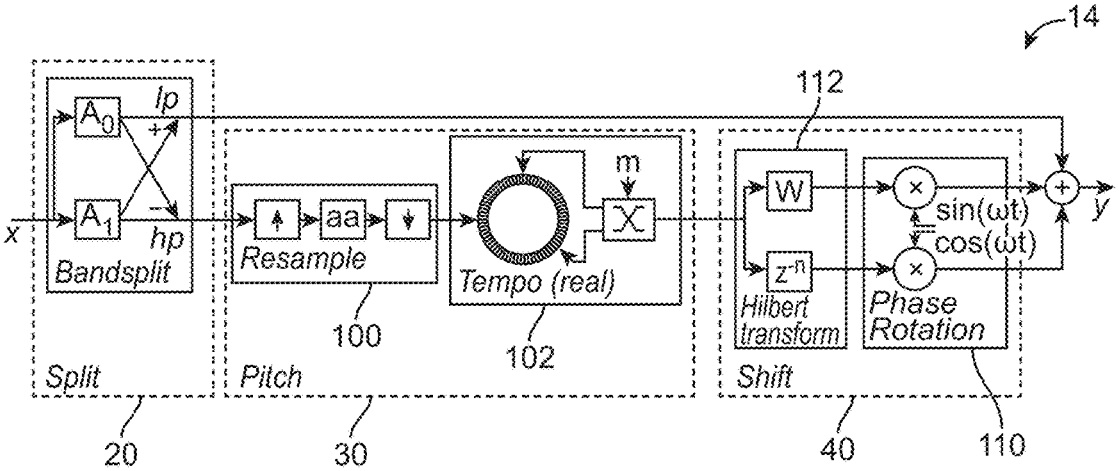
FIG. 2A illustrates one implementation of at least a part of the processing unit in the hearing device of FIG. 1 in accordance with some embodiments.

FIG. 2A illustrates one implementation of at least a part of the processing unit 14 in the hearing device 10 of FIG. 1 in accordance with some embodiments. As shown in the figure, the processing unit 14 includes the band splitter 20, the pitch shifter 30, and the frequency shifter 40. The pitch shifter 30 includes a resampler 100. As shown in the figure, the hearing device 10 also includes a tempo adjuster 102. In the illustrated embodiments, the tempo adjuster 102 is shown to be a part of the pitch shifter 30. In other embodiments, the tempo adjuster 102 may be considered to be separate from the pitch shifter 30.

The frequency shifter 40 includes a phase rotation module 110. As shown in the figure, the hearing device 10 also includes a Hilbert transform module 112 coupled to the phase rotation module 110. In the illustrated embodiments, the Hilbert transform module 112 is shown to be a part of the frequency shifter 40. In other embodiments, the Hilbert transform module 112 may be considered to be separate from the frequency shifter 40.

In the illustrated embodiments, the resampler 100, the Hilbert transform module 112, the tempo adjuster 102, and the phase rotation module 110 are coupled in series according to the following order: (1) the resampler 100, (2) the tempo adjuster 102, (3) the Hilbert transform module 112, and (4) the phase rotation module 110.

The operation of the system shown in FIG. 2A will now be described.

Band Splitter

During use, the band splitter 20 receives input signal x, and creates a high-pass signal and a low-pass signal using two all-pass filters $A_0$, $A_1$. In other embodiments, the band splitter 20 may be implemented using other techniques, and may or may not involve using all-pass filters. It should be noted that as used in this specification, the terms "input", "output", "signal", or similar terms, may refer to one or more signals. The output signals from the two all-pass filters are added to construct a low-pass response in one branch, and are subtracted to construct a high-pass response in another branch. Note that the low-pass response and the high-pass response may be added or subtracted later to get the response of one of the all pass filters. The high-pass response is transmitted downstream for processing by the resampler, 100 the tempo adjuster 102, the Hilbert transform module 112, and the phase rotation module 110. Due to the additional processing by these components, there may be a time difference between the transmissions of the low-pass response and the high-pass response. In some cases, such time difference may be ignored. In other cases, a delay element may be added to the branch for the low-pass response to reduce or minimize the time difference in group delay between the two branches.

In some cases, the band splitter 20 is configured to avoid distortion in the low frequencies, where the frequency mapping would have too much negative impact on the harmonic structure of most daily-live signals, and could cause difficulties with localization (due to the time-varying group delay). In one implementation, to minimize aliasing around the cut-off frequency of the band splitter 20, at least a fifth order bandsplit filter may be used to implement the band splitter 20, which may be implemented using two all-pass filters. In other embodiments, a bandspliter filter that is more than fifth order (e.g., seventh order bandsplit filter), or a bandspliter filter that is less than fifth order, may be used. In some cases, the implementation of the all-pass filters may consider the symmetry between pole and zero coefficients (they are identical in reversed order).

Resampler

Next, the first output from the band splitter 20 is transmitted to the resampler 100, which provides a proportional offset for one or more frequencies from the first output of the band splitter 20 to thereby obtain a desired mapping. Resampling may be used to connect two modules that operate at a different sampling rate. However, resampling can also be used to speed up or slow down play. When the resampling operation changes the number of samples in a block, while still maintaining the same input and output sampling rate, all wavelengths are affected proportionally. Up-sampling causes input frequencies to move down, and down-sampling causes input frequencies to move up. In one implementation of resampling, up-sampling is first performed by a factor N, where N is positive integer greater than one. The up-sampling may be achieved by inserting N−1 zeros between adjacent input samples. Next, the up-sampled signal may be low-pass filtered to remove mirrored spectra introduced by the inserted zeros, and (optionally) scaled to maintain the amplitude of the original signal. If the low-pass filter is zero-phase, the combination of up-sampling and scaled low-pass filtering performs an interpolation. However, for online frequency mapping, the low-pass filtering should be causal, and is therefore preferably done using a minimum phase infinite impulse response (IIR) filter. Finally, the signal is down-sampled by a factor M, where M is also a positive integer greater than one. The down-sampling is done by selecting every Mth sample from the up-sampled signal. In some cases, a resampling factor may be approximated by the rational number N/M, which corresponds to a frequency compression/expansion slope M/N.

In the figure, the term 'aa' in the resampler 100 represents Anti Aliasing. The [up]→[aa]→[down] represents the theoretical steps to resample a signal. UP inserts zeros, DOWN discards samples, and AA suppresses aliasing (because the basic up/down sampling introduces shifted copies of the spectrum that should not be audible at the final output). In some cases, AA may be implemented using a low-pass filter with a cutoff frequency set to match the desired output bandwidth (e.g., the new Nyquist frequency). For example the signal x=1 2 3 4 5 6 . . . may be resampled by a factor 2/3 as follows:

"1 2 3 4 5 6 . . . "→[UP 2]→"1 0 2 0 3 0 4 0 5 0 6 0 . . . "→[AA]→"1 1.5 2 2.5 3 3.5 4 4.5 5 5.5 6 ? . . . "→[DOWN 3]→"1 2.5 4 5.5 . . . "

So with AA (here a simple linear interpolation), we get "1 2 3 4 5 6 . . . "→"1 2.5 4 5.5 . . . " Note that without AA, the result would have been: "1 0 4 0", which would be undesirable because the zeros in that sequence cause audible distortion (aliasing). In some cases, for a more efficient implementation, the AA filter may be integrated with the UP/DOWN steps to ensure that only samples are calculated that contribute to the output of the resample block. For example, in the example above, the values 1.5, 3.5 and 4.5 do not need to be calculated because they are dropped by the [DOWN 3].

In other embodiments, the resampler 100 may not perform both up-sampling and down-sampling. For example, for up-sampling (for frequency compression by a factor 2), the resampler 100 would only need to perform: [UP x2]→[AA], and the down-sampling may be omitted. On the other hand, for a simple frequency expansion, the resampler 100 may perform: [AA]→[DOWN], and the up-sampling may be omitted. In further embodiments, if a very flexible compression/expansion slope is desired, the resampler 100 may perform: [UP]→[AA]→[LIN INTERP], where the "[LIN INTERP]" block may use linear interpolation to pick samples at an arbitrary interval.

In another implementation, the theoretical low-pass filter may be splitted into multiple shorter filters, each running at its own interval on the original input signal. By multiplexing the outputs, the low-pass filtered up-sampled signal is then calculated without multiplications by zero.

To improve efficiency of the low-pass filter further, the number of pole coefficients at the expense of an increased number of zero coefficients may be reduced or minimized. Also, up-sampling may be performed in multiple stages. For example, the resampler 100 may first up-sample by a factor two and may apply an optimized IIR low-pass filter with two poles. Then, to up-sample further, the resampler 100 may continue with stages using finite impulse response (FIR) filters of decreasing order. After up-sampling (e.g., by a factor 4 or 8), when the signal is predominately in very low frequencies relative to the up-sampled rate, the FIR low-pass filters may become so short that they only average adjacent samples. Accordingly, instead of going up to even higher sampling rates, the final output for any resampling ratio may simply be obtained by a linear interpolation.

Figure 3:
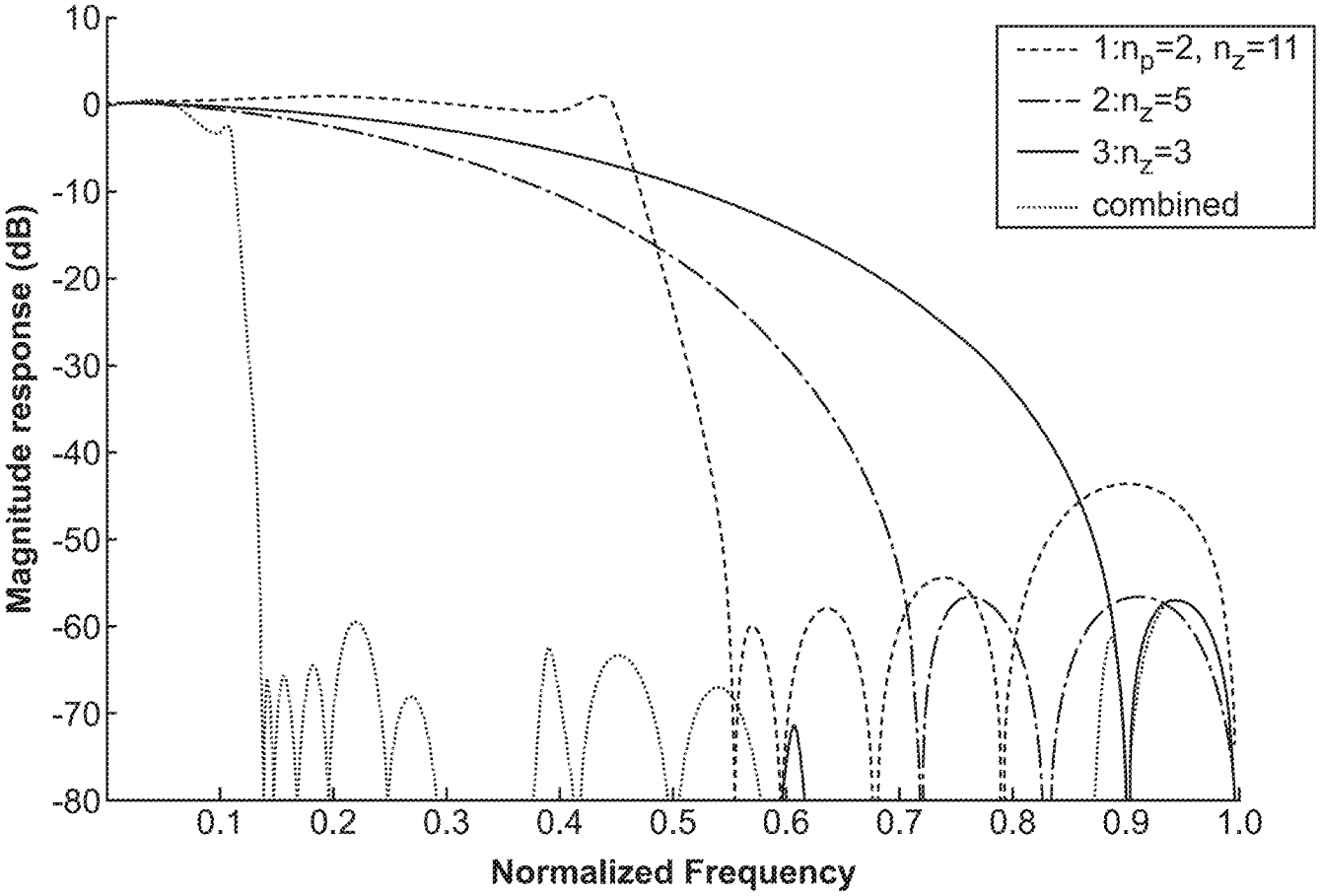
FIG. 3 shows the magnitude responses for a three stages up-sampling, and the resulting combined response.

In some embodiments, the resampler 100 may be configured to perform a 3-stage up-sampling. The first stage uses two poles and eleven zeros. The second stage uses five zeros, and the third stage uses three zeros. FIG. 3 shows the magnitude responses for the first three stages and the resulting combined response for a factor 8 up-sampling. As shown in the figure, the signal is at 0.5 after the first stage up-sampling. For the highest frequencies, the attenuation is a bit less, which may be acceptable because normally the bandsplit filter has already removed most of the low frequencies that go there by aliasing. After the second stage up-sampling, the signal reaches only up to 0.25, and its mirror spectrum starts at 0.75, which may be suppressed adequately using a symmetrical FIR filter with five zeros (no poles). After the third stage up-sampling, the signal reaches only up to 0.125, and its mirror spectrum starts at 0.875. So an even simpler FIR filter with only three zeros suffices. In some cases, by exploiting symmetry, the FIR filters may be implemented efficiently. For example, the third stage filter may be implemented using one multiplication and three additions per two samples. Other ways of implementation may be used in other embodiments.

In the above example, the first up-sampling stage is implemented using two poles. In other embodiments, the first up-sampling stage may be implemented using other number of poles, such as more than two poles. Also, in the above example, consecutive stages use FIR filters of decreasing complexity. In other embodiments, FIR filters may increase complexity in one or more stages. Furthermore, in some embodiments, alternating filters may be employed to implement insertion of zeros. In still further embodiments, all-pass filters may be used to perform the resampling. For example, for up or down sampling by a factor 2 (or other integer resampling factors), a halfband infinite impulse response (IIR) filter may be implemented efficiently using all-pass filters.

Tempo Adjuster

Returning to FIG. 2A, after the resampler 100 generates its output, the output of the resampler 100 is then transmitted to the tempo adjuster 102. The resampling by the resampler 100 may introduce a time varying delay between input and output, i.e. a buffer of samples gradually grows (or shrinks) because the number of samples going out does not match the number of samples coming in. In order to compensate for such delay, the tempo adjuster 102 maintains real time alignment by buffering the signal, and skipping (for compression) or repeating (for expansion) parts of the waveform. Ideally, the parts of the waveform that are skipped or repeated contain complete periods of a signal. In some cases, this may not be possible because the signals may be too complex, or simply lack periodicity. However, for most signals, noticeable distortions may be minimized quite effectively by selecting appropriate segments. Once the segments have been identified, e.g., by points in time where the local waveforms are similar, noticeable distortions may be reduced or minimized further by applying a cross-fader to smoothen transitions.

Figure 4:
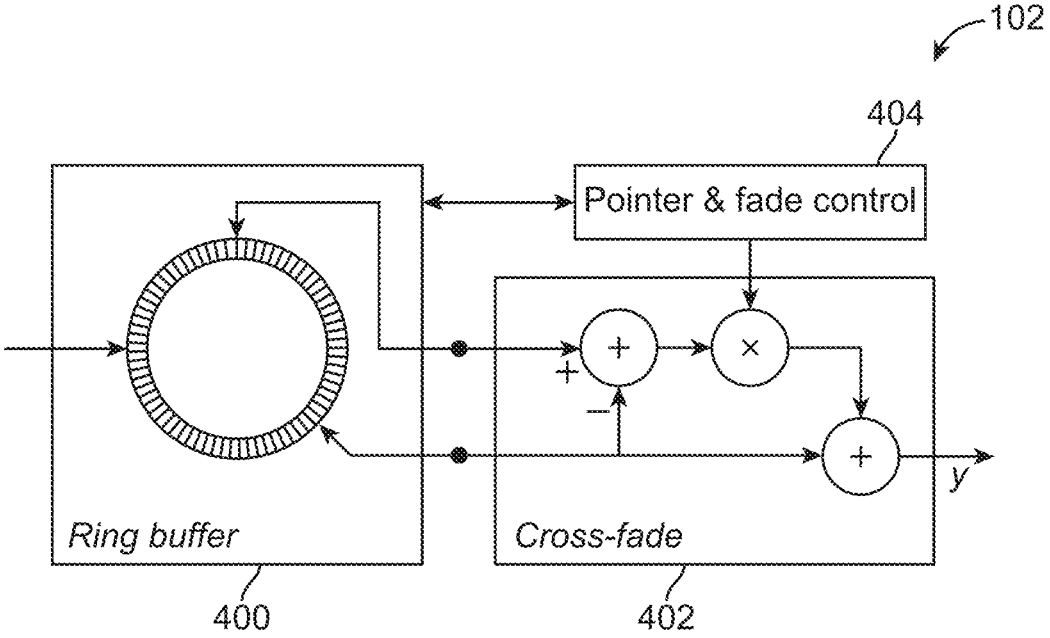
FIG. 4 shows an implementation of a tempo adjuster.

FIG. 4 shows a ring buffer 400 that may be used to implement the tempo adjuster 102. A cross-fader 402 is coupled to the ring buffer 400. As shown in the figure, a pointer and fade control 404 is coupled to the ring buffer 400 and the cross-fader 402. The ring buffer 400, the cross-fader 402, and the pointer and fade control 404 may be considered parts of the tempo adjuster 102. During use, the ring buffer 400 is filled at a rate different from the output sampling frequency. One technique to compensate for such is to jump ahead or back over some samples. In some embodiments, to reduce or minimize noticeable distortion during jumps, the system may try to match the local waveforms of the two streams, and/or to use cross-fading to smooth the transitions. Waveform matching may be done by comparing a small window of samples, and performing a search for a similar location before jumping. Alternatively, the system may reshape the signal at desired pointer locations (e.g., by applying a phase transformation).

In some cases, when a jump is performed between pointers, phase alignment is also performed. For example, for an analytic signal, with samples represented as vectors in the complex plane, the instantaneous phase is represented by angle, and the instantaneous magnitude is represented by length. One technique to align the waveform at sample $v_2$ $(x_2+iy_2)$ at buffer location 2 with the waveform at sample $v_1(x_1+iy_1)$ at buffer location 1 is to rotate angle($v_2$) to angle($v_1$).

Also, in the illustrated example of FIG. 4, the cross-fader controls the cross-fade by performing a multiplication with a value between 0 and 1. When the mixer value is 0, only the pointer from the bottom branch is used, and when it is 1, only the other pointer is used. For values in between, a linear mix of the two signals is used. An alternative implementation would be to give each path it's own window function, which gives more control over how the distortion from the cross-fade spreads out to nearby frequencies. In some cases, a simple linear cross-fade may be used.

In the illustrated embodiments of FIG. 2A, the tempo adjuster 102 is configured to operate on real signal. When the signal is real, the waveforms may be matched within some desired target range, depending on buffer sizes, maximum delay, and processing power. For example, a local one-norm dissimilarity criterion may be used. In such technique, a point in time where the waveform is similar may be searched for.

In other embodiments, the tempo adjuster 102 may be configured to operate on an analytic signal, such as that obtained from a Hilbert transformer (Hilbert transform module). When the signal is analytic, the above described search is not needed. Instead, an arbitrary point in time may be selected (e.g., at a maximal distance, which minimizes the number of transitions per second), and then a search may be performed for the optimal phase adjustment. Analytic tempo adjustment provides a near-perfect performance on simple signals, such as a linear chirp. Analytic tempo adjustment will be described below with reference to the embodiments of FIG. 7.

It should be noted that the pitch shifter 30 is not limited to providing proportional offset to input frequencies (i.e., $f_{out}=\alpha f_{in}$) using the above techniques. For example, in other embodiments, in an FFT-based design, the mapping (i.e., $f_{out}=\alpha f_{in}$) by the pitch shifter 30 may be approximated by redistributing bands.

Hilbert Transform Module

Returning to FIG. 2A, after the tempo adjuster 102 provides its output, the output of the tempo adjuster 102 is then transmitted to the Hilbert transform module 112. Frequency shifting ($f_{out}=f_{in}+\Delta$) adds a constant offset to input frequencies. In the illustrated embodiments, such may be accomplished by modulating analytic signals obtained from the Hilbert transform module 112.

The Hilbert transform module 112 is configured to convert a real signal into an orthogonal signal pair, where one is 90° phase-shifted compared to the other. The two signals coming out of the Hilbert transform module 112 form an analytic signal where one provides the real value, and other provides the imaginary value. The discrete time impulse response for a 90° phase shift is given by $$h[n]=\begin{cases}0 & \forall\, n \text{ even}\\ \dfrac{2}{n\pi} & \forall\, n \text{ odd}\end{cases} \tag{1}$$

which may form the basis for designing a linear phase implementation. Two observations can be made from the above equation (1). First, half of the filter taps of the theoretical response are zero. Second, the positive and negative tap-weights come in anti-symmetrical pairs. Both of these observations may be exploited to reduce computational complexity.

Figure 5A:
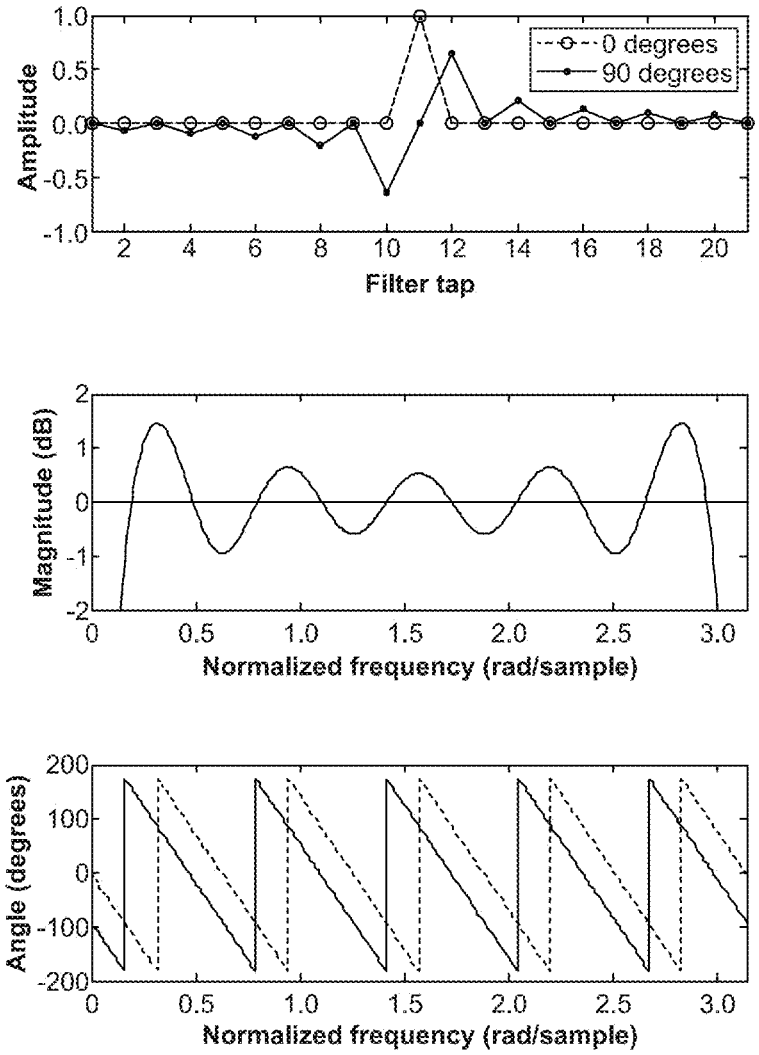
FIG. 5A shows truncated theoretical Hilbert transformer response.
Figure 5B:
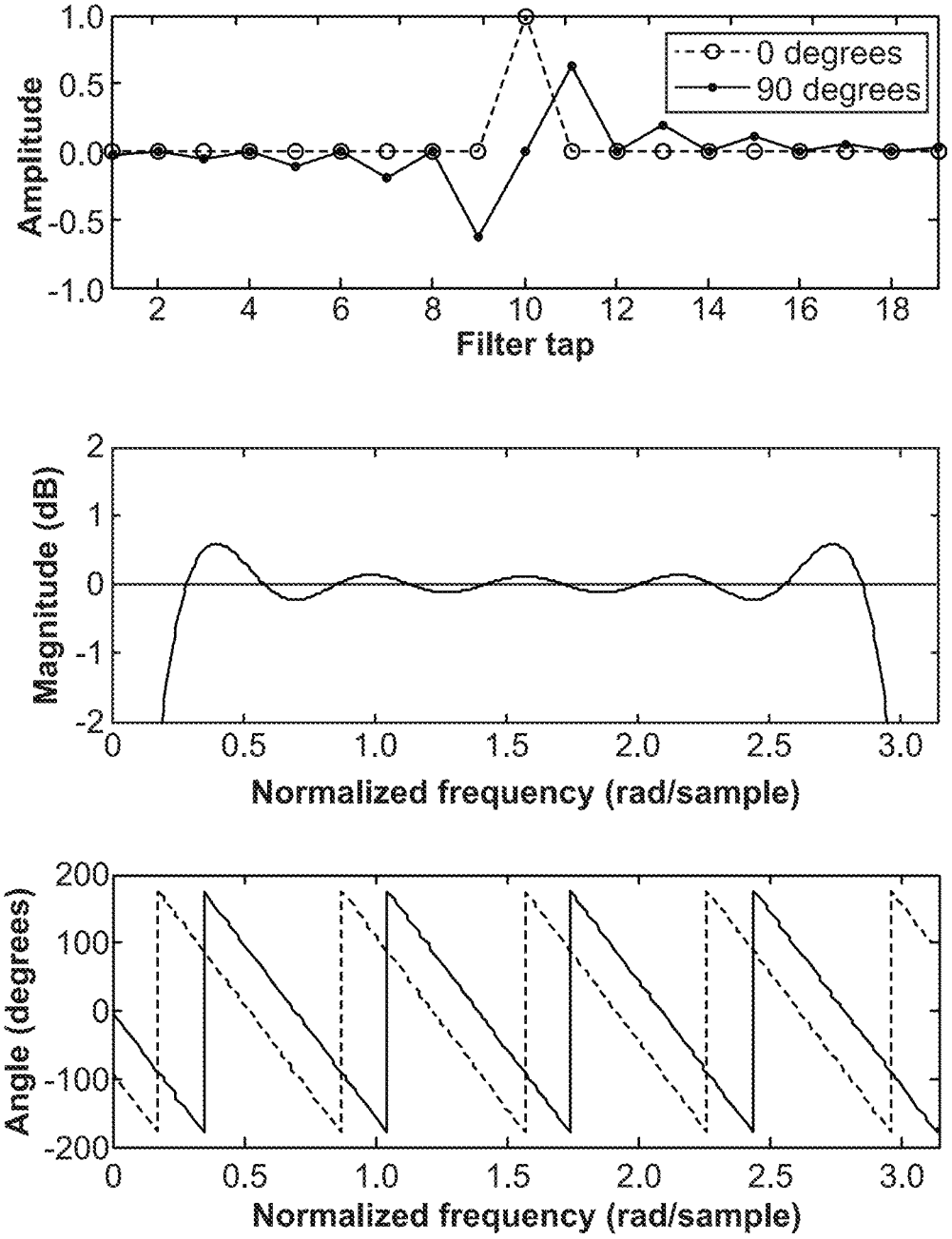
FIG. 5B shows optimized Hilbert transformer response.

In one implementation of the Hilbert transform module 112, theoretical response may be truncated at some finite order, and a corresponding delay may be added for causality. For a $20^{th}$ order FIR implementation, this may result in the response shown in FIG. 5A. Due to the anti-symmetry of the filter weights, such a truncated response may still maintain a perfect 90° phase shift. In some cases, such a response may suffer from ripple in the magnitude in the magnitude response, such as near DC and Nyquist. Since the lowest and highest frequencies may be relatively unimportant, the filter weights may be optimized to reduce or minimize ripple in the mid-frequency range. In some cases, the Hilbert transform module 112 may employ an optimization procedure to obtain the response shown in FIG. 5B.

In other embodiments, instead of FIR filters, all-pass filters may be used to implement the Hilbert transform module 112. This may be done by replacing the unit delay and FIR filter elements by all-pass filters. Such technique may result in lower group delay and possibly also lower computational complexity (but the response would no longer be linear phase).

Phase Rotation Module

Returning to FIG. 2A, after the Hilbert transform module 112 generates its output, the output of the Hilbert transform module 112 is then transmitted to the phase rotation module 110. As discussed, frequency shifting ($f_{out}=f_{in}+\Delta$) adds a constant offset to input frequencies. In the illustrated embodiments, such is accomplished by the phase rotation module 110 modulating analytic signals obtained from the Hilbert transform module 112.

In one implementation, the phase rotation module 110 is configured to perform phase rotation by modulating the analytic signal from the Hilbert transform module 112 with sine and cosine functions. In particular, the vector [sin(wt), cos(wt)] describes rotating a point on a unit circle in a two dimensional plane where w represents the angular velocity (radians/s) and t represents time. Assume some complex valued input sample v:

$v=x+iy$ (so $x$ represents the real part, $y$ the imaginary part, i.e., $x$=real($v$), $y$=imag($v$))

If v is rotated by some angle in the complex plain, the result is:

$$v_rotated=(\sin(angle)*x+\cos(angle)*y)+i*(\cos(angle)*x-\sin(angle)*y)$$

On the other hand, if a real signal output is desired, the right half may be ignored, and the result is:

$$\text{Real}(v_rotated)=\sin(angle)*x+\cos(angle)*y$$

In some cases, to implement a frequency shift, it may be desirable to make the angle time variant (so the angle/phase rotates at a constant rate). To explain, take two (analytic) signals (v1 and v2):

$$v1(t)=\cos(f1*2*pi*t)+i*\sin(f1*2*pi*t)=\exp(i*f1*2*pi*t)$$

$$v2(t)=\exp(i*f2*2*pi*t)$$

representing complex valued pure tones with frequencies f1 and f2. If they are multiplied together, the result is: v_modulated(t)=v1(t)*v2(t)=exp(i*f1*2*pi*t)*exp(i*f2*2*pi*t)=exp(i*(f1+f2)*2*pi*t), which shows that the multiplied signals produce a new tone with a frequency shifted to f1+f2. In some cases, if only a real output is of interest, this simplifies to: Real(v_modulated(t))=Real(exp(i*(f1+f2)*2*pi*t))=cos((f1+f2)*2*pi*t).

In some cases, lookup-table may be employed for allowing sine and cosine values be read from. If the lookup table is small, the phase rotation module 110 may perform some interpolation to improve accuracy. Two multiplications (one for the sine value, and the other for the cosine value) per sample may suffice if real signal is desired to be the output. In case analytic output is desired (such as in the case in which the output of the phase rotation module 110 is fed into the tempo adjuster 102, as described below with reference to FIG. 8), then four multiplications per sample may be used. In other embodiments, the number of multiplications for real output or analytic output may be different from the examples described previously. In some cases, for increasing efficiency, the phase rotation module 110 may be configured to derive either the sine or cosine from the other by appropriately selecting the modulation frequency for an integer offset in the signal buffers.

It should be noted that the frequency shifter 40 is not limited to providing a constant offset to input frequencies (i.e., $f_{out}=f_{in}+\Delta$) using the above techniques. For example, in other embodiments, in an FFT-based design, the mapping (i.e., $f_{out}=f_{in}+\Delta$) by the frequency shifter 40 may be approximated by moving or modulating bands. Thus, in other embodiments, the frequency shifter 40 may comprise a FFT transform module. Also, in further embodiments, the frequency shifter 40 may comprise an amplitude modulator and one or more filters coupled to the amplitude modulator.

As shown in FIG. 2A, after the phase rotation module 110 generates its output, the output from the phase rotation module 110 is then transmitted to an adder, which adds the second output signal from the band splitter 20, and the output from the phase rotation module 110, to generate an output y.

Figure 2B:
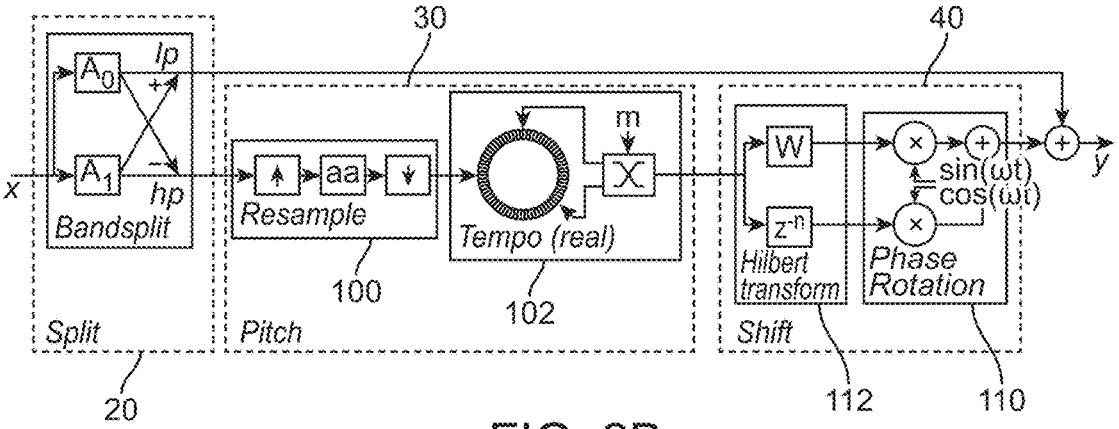
FIG. 2B illustrates at least a part of the processing unit in the hearing device of FIG. 1 in accordance with other embodiments.

In the illustrated embodiments, the phase rotation module 110 is illustrated as providing two output signals (corresponding with sin(wt) and cos (wt)). In other embodiments, the phase rotation module 110 may include an adder that combines the two signals to generate an output signal (such as that shown in FIG. 2B). The output signal from the phase rotation module 110 is then combined with the low-pass output from the band splitter 20 to generate output y.

In some cases, the system of FIG. 2A may perform frequency compression by (1) splitting incoming signal using the band splitter 20 at desired compression knee point, (2) pitching down, depending on desired compression ratio, and (3) shifting high frequencies to re-align at the knee point.

Figure 6:
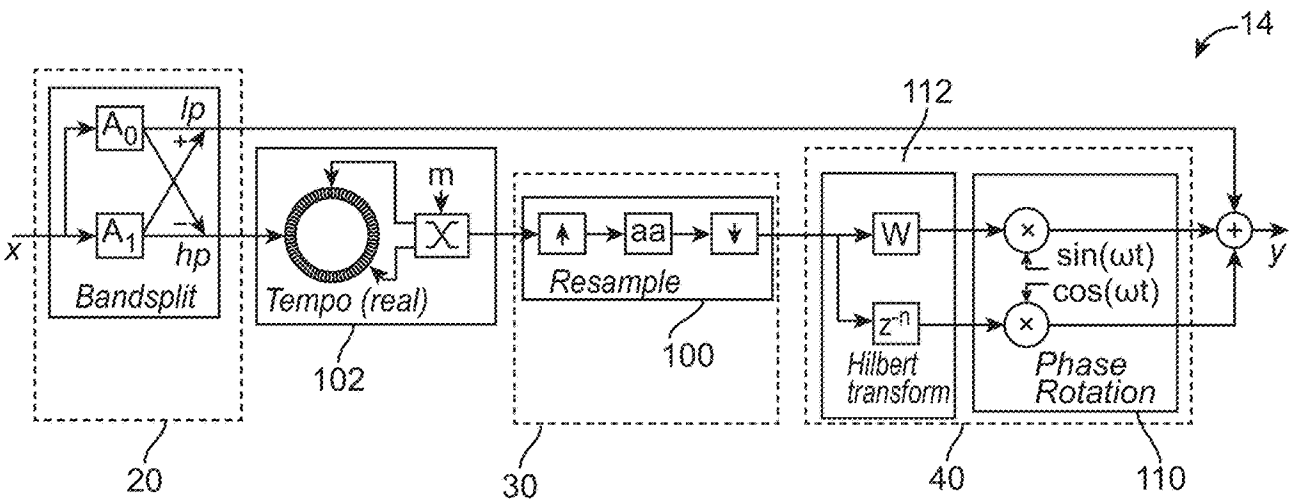
FIG. 6 illustrates another implementation of at least a part of the processing unit the hearing device of FIG. 1 in accordance with other embodiments.

FIG. 6 illustrates another implementation of at least a part of the processing unit 14 in the hearing device 10 of FIG. 1 in accordance with other embodiments. The system shown in FIG. 6 is the same as that shown in FIG. 2A, except that the order of the resampler 100 and the tempo adjuster 102 is switched. In the illustrated embodiments, the resampler 100, the Hilbert transform module 112, the tempo adjuster 102, and the phase rotation module 110 are coupled in series according to the following order: (1) the tempo adjuster 102, (2) the resampler 100, (3) the Hilbert transform module 112, and (4) the phase rotation module 110. The functions of each of these components are similarly described with reference to the embodiments of FIG. 2A. Also, in some embodiments, the tempo adjuster 102 may have the configuration shown in FIG. 4. Furthermore, in some embodiments, the phase rotation module 110 may have the configuration shown in FIG. 2B.

During use, the band splitter 20 receives input x, and generates its output, which includes a first output signal and a second output signal. The first output signal of the band splitter 20 is then transmitted to the tempo adjuster 102. The tempo adjuster 102 generates its output based on the output of the band splitter 20, and transmits its output to the resampler 100. The resampler 100 generates its output based on the output of the tempo adjuster 102, and transmits its output to the Hilbert transform module 112. The Hilbert transform module 112 generates its output based on the output of the resampler 100, and transmits its output to the phase rotation module 110. The phase rotation module 110 generates its output based on the output of the Hilbert transform module 112, and transmits its output to an adder. The adder also receives the second output signal from the band splitter 20, and adds the second output signal to the output of the phase rotation module 110 to obtain output y.

The embodiments of FIG. 6 are advantageous because it reduces complexity of computation by changing the order of the resampler 100 and the tempo adjuster 102 at the expense of quality of the waveform alignment.

Figure 7:
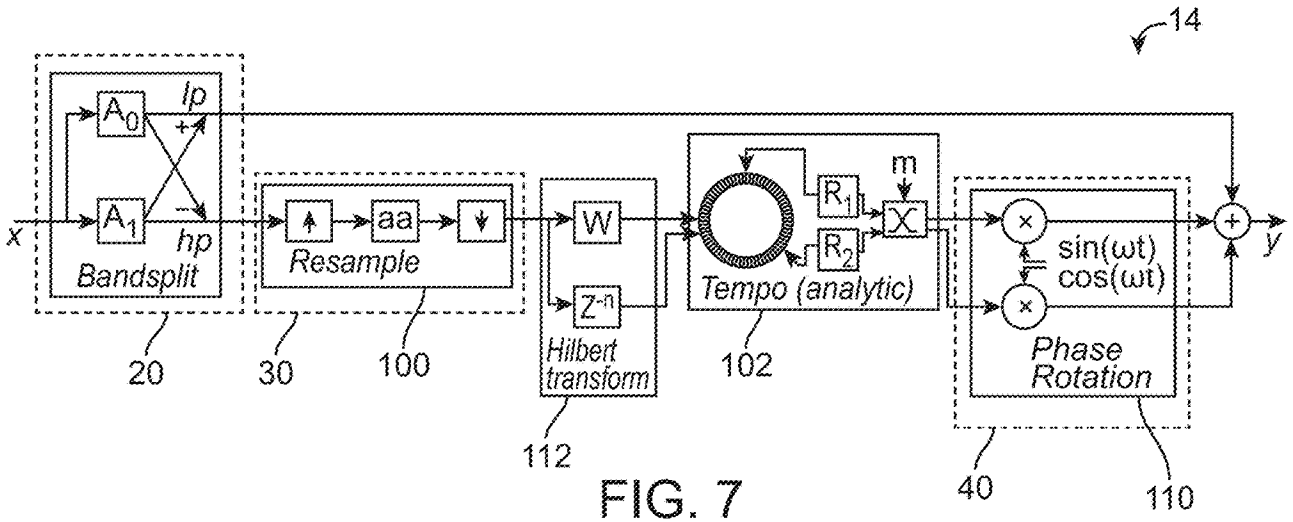
FIG. 7 illustrates another implementation of at least a part of the processing unit in the hearing device of FIG. 1 in accordance with other embodiments.

FIG. 7 illustrates another implementation of at least a part of the processing unit 14 in the hearing device 10 of FIG. 1 in accordance with other embodiments. The system shown in FIG. 7 is the same as that shown in FIG. 2A, except that the placement of the tempo adjuster 102 and the Hilbert transform module 112 is switched. In the illustrated embodiments, the resampler 100, the Hilbert transform module 112, the tempo adjuster 102, and the phase rotation module 110 are coupled in series according to the following order: (1) the resampler 100, (2) the Hilbert transform module 112, (3) the tempo adjuster 102, and (4) the phase rotation module 110. The functions of each of these components are similarly described with reference to the embodiments of FIG. 2A. Also, in some embodiments, the tempo adjuster 102 may have the configuration shown in FIG. 4. Furthermore, in some embodiments, the phase rotation module 110 may have the configuration shown in FIG. 2B.

During use, the band splitter 20 receives input x, and generates its output, which includes a first output signal and a second output signal. The first output signal of the band splitter 20 is then transmitted to the resampler 100. The resampler 100 generates its output based on the output of the band splitter 20, and transmits its output to the Hilbert transform module 112. The Hilbert transform module 112 generates its output based on the output of the resampler 100, and transmits its output to the tempo adjuster 102. The tempo adjuster 102 generates its output based on the output of the Hilbert transform module 112, and transmits its output to the phase rotation module 110. Thus, in the illustrated embodiments, tempo adjustment is performed on the analytic signal, as opposed to real signal. It should be noted that the output of the tempo adjuster 102 is still analytic (e.g., complex-value). The phase rotation module 110 generates its output based on the output of the tempo adjuster 102, and transmits its output to an adder. The adder also receives the second output signal from the band splitter 20, and adds the second output signal to the output of the phase rotation module 110 to obtain output y.

The embodiments of FIG. 7 are advantageous because it improves quality of the waveform alignment by performing tempo adjustment on the analytic signal, which comes at the expense of increased computations for maintaining analytic signals. For frequency expansion, the illustrated configuration is also advantageous because the resampler 100 will sample down, reducing the processing demand for the tempo adjuster 102. Also, the system of FIG. 7 is advantageous because it provides better sound quality resulted from more control over the phase in the tempo adjuster 102. The system also provides a more predictable delay in the signal path because when cross-fades occur may be determined exactly. In particular, the delay and processing are relatively more predictable because unlike the real signal version, which searches for an appropriate fade-point, exactly how many samples are processed may be determined/specified before initiating a cross fade. Furthermore, the system can provide a perfect chirp response. In addition, for simple tonal signals, the phase alignment is perfect or nearly perfect.

Figure 8:
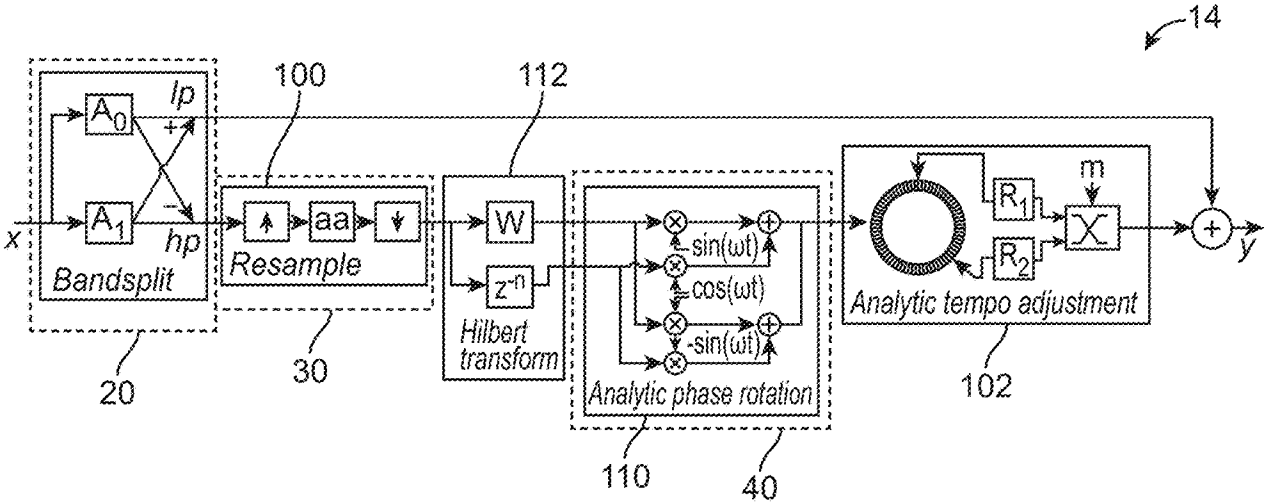
FIG. 8 illustrates another implementation of at least a part of the processing unit in the hearing device of FIG. 1 in accordance with other embodiments.

FIG. 8 illustrates another implementation of at least a part of the processing unit 14 in the hearing device 10 of FIG. 1 in accordance with other embodiments. The system shown in FIG. 8 is the same as that shown in FIG. 7, except that the placement of the tempo adjuster 102 and the phase rotation module 110 is switched, and that the phase rotation module 110 is configured to perform phase rotation on analytic signal. In the illustrated embodiments, the resampler 100, the Hilbert transform module 112, the tempo adjuster 102, and the phase rotation module 110 are coupled in series according to the following order: (1) the resampler 100, (2) the Hilbert transform module 112, (3) the phase rotation module 110, and (4) the tempo adjuster 102. The functions of each of these components are similarly described with reference to the embodiments of FIG. 2A. Also, in some embodiments, the tempo adjuster 102 may have the configuration shown in FIG. 4.

During use, the band splitter 20 receives input x, and generates its output, which includes a first output signal and a second output signal. The first output signal of the band splitter 20 is then transmitted to the resampler 100. The resampler 100 generates its output based on the output of the band splitter 20, and transmits its output to the Hilbert transform module 112. The Hilbert transform module 112 generates its output based on the output of the resampler 100, and transmits its output to the phase rotation module 110. The phase rotation module 110 generates its output based on the output of the Hilbert transform module 112, and transmits its output to the tempo adjuster 102. The phase rotation module 110 is configured to implement a rotation in the complex plane. In the illustrated embodiments, the output of the phase rotation module 110 is an analytic signal, and tempo adjustment is performed on the analytic signal. The tempo adjuster 102 generates its output based on the output of the phase rotation module 110, and transmits its output to an adder. The adder also receives the second output signal from the band splitter 20, and adds the second output signal to the output of the tempo adjuster 102 to obtain output y.

Figure 9:
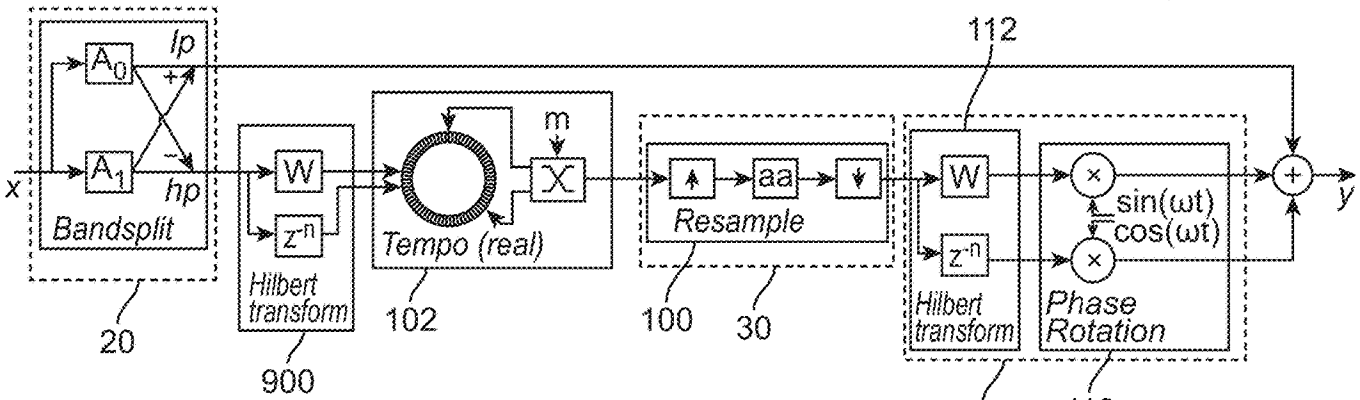
FIG. 9 illustrates another implementation of at least a part of the processing unit in the hearing device of FIG. 1 in accordance with other embodiments.

FIG. 9 illustrates another implementation of at least a part of the processing unit 14 in the hearing device 10 of FIG. 1 in accordance with other embodiments. The system shown in FIG. 9 is the same as that shown in FIG. 6, except that it includes an additional Hilbert transform module 900 before the tempo adjuster 102. In the illustrated embodiments, the resampler 100, the Hilbert transform module 900 (first Hilbert transform module), the Hilbert transform module 112 (second Hilbert transform module), the tempo adjuster 102, and the phase rotation module 110 are coupled in series according to the following order: (1) the first Hilbert transform module 900, (2) the tempo adjuster 102, (3) the resampler 100, (4) the second Hilbert transform module 112, and (5) the phase rotation module 110. The functions of each of these components are similarly described with reference to the embodiments of FIG. 2A. Also, in some embodiments, the tempo adjuster 102 may have the configuration shown in FIG. 4. Furthermore, in some embodiments, the phase rotation module 110 may have the configuration shown in FIG. 2B.

During use, the band splitter 20 receives input x, and generates its output, which includes a first output signal and a second output signal. The first output signal of the band splitter 20 is then transmitted to the first Hilbert transform module 900. The first Hilbert transform module 900 generates its output based on the output of the band splitter 20, and transmits its output to the tempo adjuster 102. The tempo adjuster 102 generates its output based on the output of the first Hilbert transform module 900, and transmits its output to the resampler 100. The resampler 100 generates its output based on the output of the tempo adjuster 102, and transmits its output to the second Hilbert transform module 112. The second Hilbert transform module 112 generates its output based on the output of the resampler 100, and transmits its output to the phase rotation module 110. The phase rotation module 110 generates its output based on the output of the second Hilbert transform module 112, and transmits its output to an adder. The adder also receives the second output signal from the band splitter 20, and adds the second output signal to the output of the phase rotation module 110 to obtain output y.

In the illustrated embodiments, tempo adjustment is performed by the tempo adjuster 102 on an analytic signal input with the output of the tempo adjuster 102 being a real signal. Then Hilbert transform is performed again for the frequency shift. Note that for frequency compression/lowering, it may be a good idea to first adjust the tempo because it lowers the sample rate for the rest of the system. So even though it may seem inefficient to have two Hilbert transform modules, it may still be desirable because it provides a more precise phase alignment in the tempo adjuster 102.

It should be noted that the order of the various components is not limited to the examples described previously, and that the order of the various components in the system may be different in other embodiments. For example, in other embodiments, for some mappings, the resampler 100 may be implemented last.

In one implementation, the resampler 100, the Hilbert transform module 112, the tempo adjuster 102, and the phase rotation module 110 are coupled in series according to the following order: (1) the Hilbert transform module 112, (2) the phase rotation module 110, and (3) the tempo adjuster 102, and (4) the resampler 100. Such configuration may be useful for the frequency expansion case (shift down, pitch up). The functions of each of these components are similarly described with reference to the embodiments of FIG. 2A. During use, the band splitter 20 receives input x, and generates its output, which includes a first output signal and a second output signal. The first output signal of the band splitter 20 is then transmitted to the Hilbert transform module 112. The Hilbert transform module 112 generates its output based on the output of the band splitter 20, and transmits its output to the phase rotation module 110. The phase rotation module 110 generates its output based on the output of the Hilbert transform module 112, and transmits its output to the tempo adjuster 102. The tempo adjuster 102 generates its output based on the output of the phase rotation module 110, and transmits its output to the resampler 100. The resampler 100 generates its output based on the output of the tempo adjuster 102, and transmits its output to an adder. The adder also receives the second output signal from the band splitter 20, and adds the second output signal to the output of the tempo adjuster 102 to obtain output y.

Figure 10:
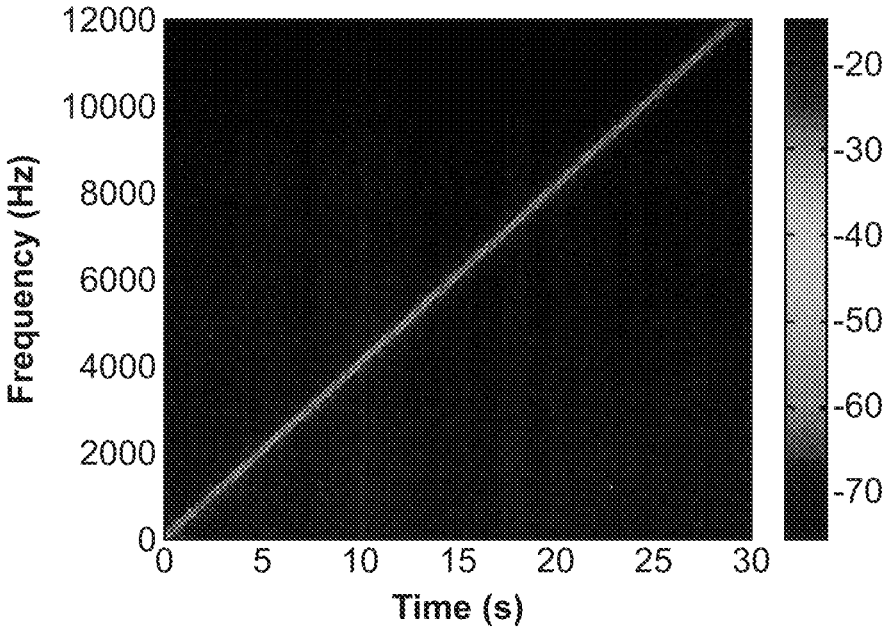
FIG. 10 illustrates a first test signal that is a linear chirp, and a second test signal that is a combination of two chirps plus three constant pure tones.
Figure 10:
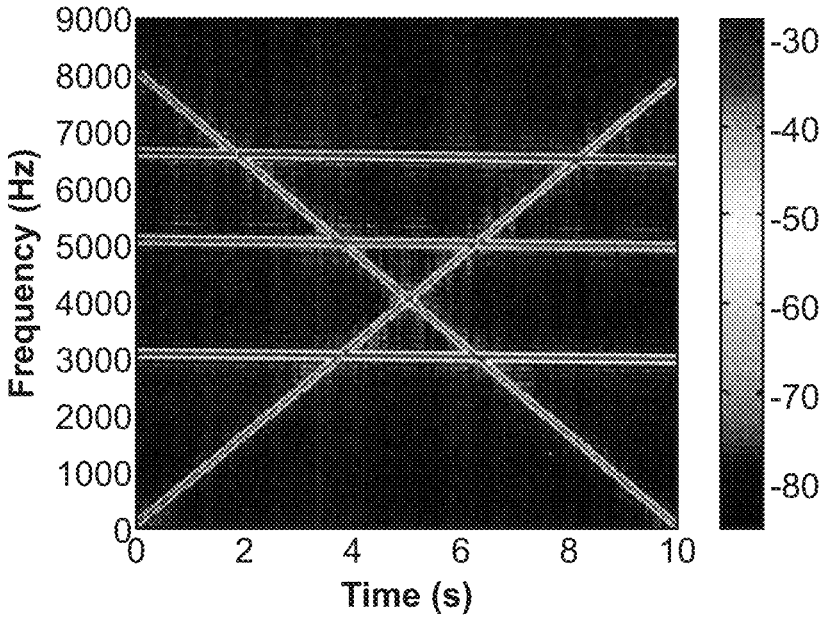
Figure 11:
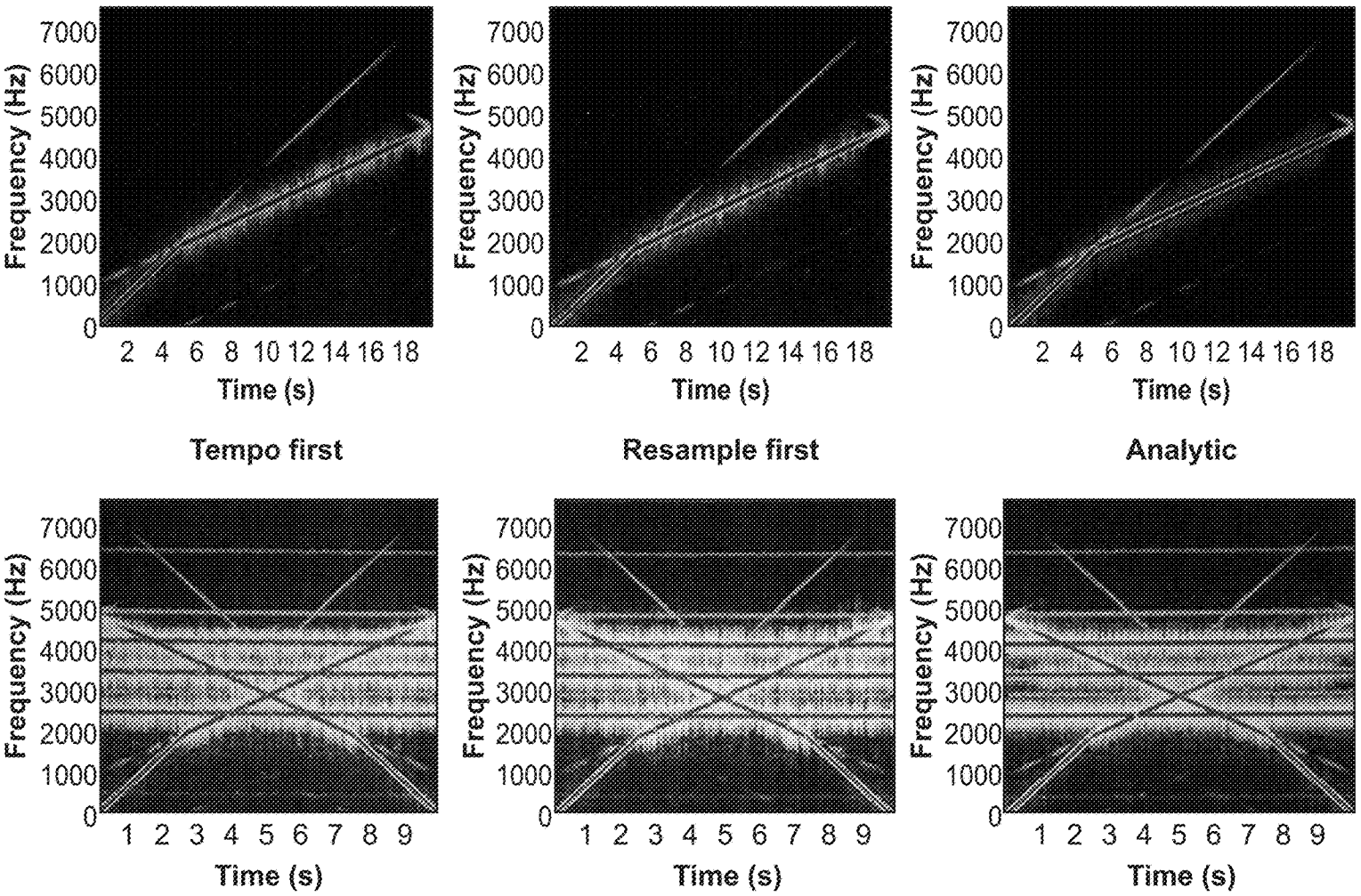
FIG. 11 illustrates spectrograms for the output using the embodiments of FIGS. 6, 2, and 7, respectively.

Embodiments described herein are advantageous because they allow capturing of the features in the sound signals through the entire relevant frequency range. FIG. 10 illustrates a first test signal that is a linear chirp, and a second test signal that is a combination of two chirps plus three constant pure tones. FIG. 11 illustrates spectrograms for the output using the embodiments of FIGS. 6, 2A/2B, and 7, respectively. In particular, the spectrum at the left side of FIG. 11 is generated using the scheme shown in FIG. 6 to process the first and second test signals of FIG. 10, the spectrum in the middle is generated using the scheme shown in FIG. 2A/2B, and the spectrum at the right side is generated using the scheme shown in FIG. 7. The linear chirp responses show that quality improves for the more complex schemes (e.g., the analytic scheme of FIG. 7). As shown in the spectrograms in FIG. 11, the techniques described herein are advantageous because they allow capturing of the features in the test signals through the entire relevant frequency range. This is beneficial over some existing systems, which are capable of capturing only some features in test signals in a limited portion of the relevant frequency range.

One or more embodiments of the frequency adjustment solution described herein are advantageous because they may not result in any discontinuities in the frequency input-output mapping. Also, the solution may be model-free, thereby allowing direct approach to achieve frequency mapping. However, in other embodiments, modeling technique may be used to implement one or more features described herein. Also, embodiments described herein are not environment-dependent, and do not involve any adaptation. This means one output frequency uniquely corresponds to one input frequency. However, in other embodiments, adaptation technique and/or environment-dependent technique may optionally be incorporated into the solution.

It should be noted that the processing unit 14 may be implemented using a processor (e.g., a general purpose processor, a signal processor, an ASIC processor, a FPGA processor, or any of other types of processor), a plurality of processors, or any integrated circuit. Also, in some embodiments, part(s) or an entirety of the processing unit 14 may be implemented using any hardware, software, or combination thereof.

Also, in any of the embodiments described herein, the output from the tempo adjuster 102 may be a real output (in which case, the tempo adjuster 102 may pick the readily available 0° signal or the 90° signal, or rotate to any other angle if so desired, for output). In other embodiments, the output from the tempo adjuster 102 may include both real output and imaginary output (i.e., again an analytic signal). In such cases, the system may include another component (e.g., analysis block) that could benefit from the analytic signal representation (e.g., for power estimation).

In the above embodiments, the hearing device 10 has been described as having a module for performing the Hilbert transform. In other embodiments, instead of performing the Hilbert transform, the module may use other techniques for implementing the frequency shift. For example, in other embodiments, the hearing device 10 may have a module configured to use amplitude modulation (AM) with some additional filtering (e.g., by one or more filters) to take care of aliasing (AM shifts frequencies in both directions, so for a simple small shift the spectrum would self-overlap, but perhaps with sufficient bandwidth and some additional band-pass filtering it could be done in multiple steps). Such technique results in a generation of a single sideband to remove the negative frequencies in a real signal.

In further embodiments, the hearing device 10 may have a module configured to perform FFT transform so that values are shifted to different frequency bins (or for small shifts, by modulating the value in one bin). In some cases, the FFT transform may be considered as a type of Hilbert transform because for each frequency bin, there is a real and an imaginary value (so in each band, there is a complex-valued signal).

Also, in other cases, instead of, or in addition to, frequency compression, one or more embodiments described herein may be employed for frequency expansion. For example, if frequency resolution is poor, or a user has a dead frequency region, it may be useful to expand the frequency range. For example, the frequencies from 2 to 5 kHz may be stretched out over a range from 2 to 8 kHz using one or more techniques described herein.

In some embodiments, one or more embodiments of the system described herein may be implemented in the processing unit 14 that also has Warp filter bank, or any of other types of filter bank. For example, for compression, the frequency mapping techniques described herein may be implemented after the Warp filter bank. For expansion, the frequency mapping techniques described herein may be implemented before the Warp filter back.

Figure 12:
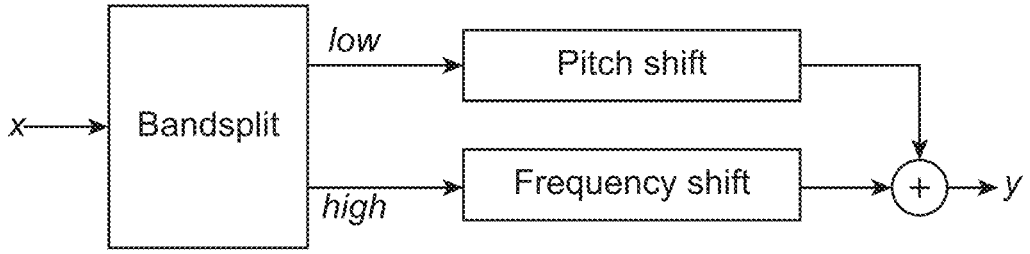
FIG. 12 illustrates at least a part of the processing unit in the hearing device of FIG. 1 in accordance with other embodiments.

In the above embodiments, the pitch shifter 30 and the frequency shifter 40 are described as being in the same branch that processes the high-pass response from the band splitter 20. In other embodiments, one or more components described herein may be implemented in the branch that processes low-pass response from the band splitter 20. For example, FIG. 12 shows at least a part of the processing unit 14 in the hearing device 10 of FIG. 1 in accordance with other embodiments. In the illustrated embodiments, the pitch shifter 30 is implemented in the branch that processes low-pass response from the band splitter 20. Such configuration may be useful to improve audibility and spectral resolution for high frequency speech cues. In other embodiments, instead of the processing/mappings shown in the figure, the branches may have other types of mappings. For example, one branch may have processing for performing frequency compression (e.g., for low frequencies), and another branch may have processing for performing frequency expansion (e.g., for high frequencies).

Figure 13:
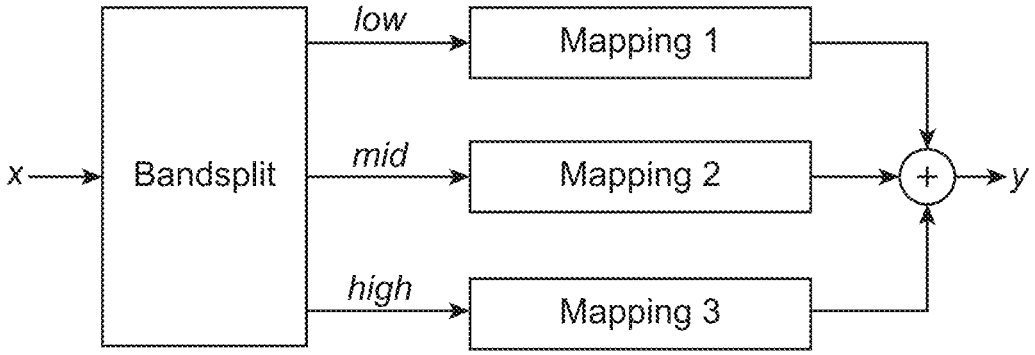
FIG. 13 illustrates at least a part of the processing unit in the hearing device of FIG. 1 in accordance with other embodiments.

FIG. 13 illustrates at least a part of the processing unit 14 in the hearing device of FIG. 1 in accordance with other embodiments. In the illustrated embodiments, the band splitter 20 provides a low-pass response for processing in a first branch, a mid-pass response for processing in a second branch, and a high-pass response for processing in a third branch. Although three branches are shown, in other embodiments, the band splitter 20 may provide output for processing in more than three branches. Two or more branches may have the same output. Alternatively, all of the branches may have different respective output. Also, in some cases, two or more of the branches may have overlapping output. As shown in the figure, each of the branches may have its own mapping(s) for processing the signals in the respective branch. The combination of pitch shifter(s) and frequency shifter(s), and any number of bandsplits may be configured to implement any piece-wise linear mapping.

As discussed, in some embodiments, the hearing device 10 may be a binaural hearing device. In such cases, it may be beneficial for spatial hearing if phase and tempo adjustments are synchronized between the left and right hearing aids, e.g., by using a wireless connection. In one implementation, the left and right hearing aids may include respective wireless communication components (e.g., transceivers) for wireless communication with each other. Each of the left and right hearing aids may include any of the embodiments of the processing unit 14 described herein. In some embodiments, the processing units 14 in the left and right hearing aids may be the same. In other embodiments, the processing units 14 in the left and right hearing aids may be different. For example, the left hearing aid may have a processing unit 14 having one of the configurations described herein (e.g., for achieving a first frequency mapping), and the right hearing aid may have a processing unit 14 having another one of the configurations described herein (e.g., for achieving a second frequency mapping that is different from the first frequency mapping). In some embodiments, the processing units 14 in respective left and right hearing aids are configured to preserve directional cues from phase and timing differences. This may be desirable when a mapping at low frequencies (where ITD cues are important for localization) is needed.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

What is claimed:

1. A hearing device comprising:

a microphone for reception of sound and conversion of the received sound into a corresponding first audio signal;

a processing unit for providing a second audio signal compensating a hearing loss of a user of the hearing device based on the first audio signal; and a receiver for providing an output sound signal based on the second audio signal;

wherein the processing unit comprises a band splitter, and a frequency shifter, and wherein the frequency shifter is arranged in a first channel; and wherein the processing unit also comprises a time-domain resampler configured to provide up-sampling by inserting data, and a time-domain tempo adjuster coupled directly or indirectly to the time-domain resampler.

2. The hearing device of claim 1, wherein the time-domain resampler is coupled between the band splitter and the time-domain tempo adjuster.

3. The hearing device of claim 1, wherein the time-domain tempo adjuster is coupled between the band splitter and the time-domain resampler.

4. The hearing device of claim 1, wherein the frequency shifter comprises a Hilbert transform module for performing a Hilbert transform.

5. The hearing device of claim 1, wherein the frequency shifter comprises an amplitude modulator and one or more filters coupled to the amplitude modulator.

6. The hearing device of claim 1, wherein the frequency shifter is configured to provide frequency shifting by an amount that is for only a subset of frequencies associated with the first audio signal.

7. The hearing device of claim 1, wherein the frequency shifter is configured to provide an output signal based on an output from the time-domain tempo adjuster.

8. The hearing device of claim 1, wherein the frequency shifter is configured to provide an output signal based on an output from the time-domain resampler.

9. The hearing device of claim 1, wherein the frequency shifter comprises a Hilbert transform module; and wherein the processing unit further includes a phase rotation module.

10. The hearing device of claim 9, wherein the time-domain resampler, the Hilbert transform module, the time-domain tempo adjuster, and the phase rotation module are coupled in series according to the following order: (1) the time-domain resampler, (2) the time-domain tempo adjuster, (3) the Hilbert transform module, and (4) the phase rotation module.

11. The hearing device of claim 10, wherein the frequency shifter comprises a first Hilbert transform module; and wherein the processing unit further includes a phase rotation module, and a second Hilbert transform module; and wherein the time-domain resampler, the first Hilbert transform module, the second Hilbert transform module, the time-domain tempo adjuster, and the phase rotation module are coupled in series according to the following order: (1) the first Hilbert transform module, (2) the time-domain tempo adjuster, (3) the time-domain resampler, (4) the second Hilbert transform module, and (5) the phase rotation module.

12. The hearing device of claim 9, wherein the time-domain resampler, the Hilbert transform module, the time-domain tempo adjuster, and the phase rotation module are coupled in series according to the following order: (1) the t time-domain empo adjuster, (2) the time-domain resampler, (3) the Hilbert transform module, and (4) the phase rotation module.

13. The hearing device of claim 9, wherein the time-domain resampler, the Hilbert transform module, the time-domain tempo adjuster, and the phase rotation module are coupled in series according to the following order: (1) the time-domain resampler, (2) the Hilbert transform module, (3) the time-domain tempo adjuster, and (4) the phase rotation module.

14. The hearing device of claim 9, wherein the time-domain resampler, the Hilbert transform module, the time-domain tempo adjuster, and the phase rotation module are coupled in series according to the following order: (1) the time-domain resampler, (2) the Hilbert transform module, (3) the phase rotation, and (4) the time-domain tempo adjuster.

15. The hearing device of claim 9, wherein the time-domain resampler, the Hilbert transform module, the time-domain tempo adjuster, and the phase rotation module are coupled in series according to the following order: (1) the Hilbert transform module, (2) the phase rotation, (3) the time-domain tempo adjuster, and (4) the time-domain resampler.

16. The hearing device of claim 1, wherein the band splitter and the frequency shifter are configured to perform signal processing for frequency mapping in a time domain.

17. The hearing device of claim 1, wherein the band splitter is configured to provide a first output in the first channel for processing to achieve the first frequency mapping, and a second output in a second channel for processing to achieve a second frequency mapping.

18. The hearing device of claim 1, wherein the band splitter is configured to provide a first output for processing in the first channel, a second output for processing in a second channel, and a third output for processing in a third channel.

19. The hearing device of claim 1, wherein the microphone, the processing unit, and the receiver are parts of a behind-the-ear (BTE) hearing aid, an in-the-ear (ITE) hearing aid, an in-the-canal (ITC) hearing aid, or a binaural hearing aid system.

20. The hearing device of claim 1, wherein the time-domain resampler is a part of a pitch shifter, and is configured to provide the up-sampling in one or more stages.

21. The hearing device of claim 1, wherein the time-domain resampler is also configured to provide down-sampling.

22. The hearing device of claim 1, wherein an amount of the up-sampling is variable.

23. The hearing device of claim 1, wherein the processing unit is configured to provide up-sampling in multiple stages.

24. The hearing device of claim 1, wherein the processing unit is configured to provide anti-aliasing.

25. The hearing device of claim 1, wherein the processing unit is configured to provide up-sampling using pole(s) and zero(s).

26. A hearing device comprising:

a microphone for reception of sound and conversion of the received sound into a corresponding first audio signal;

a processing unit for providing a second audio signal compensating a hearing loss of a user of the hearing device based on the first audio signal; and a receiver for providing an output sound signal based on the second audio signal;

wherein the processing unit comprises a band splitter, and a frequency shifter, and wherein the frequency shifter is arranged in a first channel;

wherein the processing unit also comprises a time-domain resampler configured to provide up-sampling in multiple stages; and wherein the hearing device also comprises a time-domain tempo adjuster coupled directly or indirectly to the time-domain resampler.

27. The hearing device of claim 26, wherein the time-domain resampler is a part of a pitch shifter, and the hearing device comprises the pitch shifter.

28. A hearing device comprising:

a microphone for reception of sound and conversion of the received sound into a corresponding first audio signal;

a processing unit for providing a second audio signal compensating a hearing loss of a user of the hearing device based on the first audio signal; and a receiver for providing an output sound signal based on the second audio signal;

wherein the processing unit comprises a band splitter, and a frequency shifter, and wherein the frequency shifter is arranged in a first channel;

wherein the processing unit also comprises a time-domain resampler configured to provide anti-aliasing; and wherein the hearing device also comprises a time-domain tempo adjuster coupled directly or indirectly to the time-domain resampler.

29. The hearing device of claim 28, wherein the time-domain resampler is a part of a pitch shifter, and the hearing device comprises the pitch shifter.

30. The hearing device of claim 28, wherein the time-domain resampler is coupled between the band splitter and the time-domain tempo adjuster.

31. The hearing device of claim 28, wherein the time-domain tempo adjuster is coupled between the band splitter and the time-domain resampler.

32. The hearing device of claim 28, wherein the frequency shifter comprises a Hilbert transform module for performing a Hilbert transform.

33. The hearing device of claim 28, wherein the frequency shifter comprises an amplitude modulator and one or more filters coupled to the amplitude modulator.

34. The hearing device of claim 28, wherein the frequency shifter is configured to provide frequency shifting by an amount that is for only a subset of frequencies associated with the first audio signal.

35. The hearing device of claim 28, wherein the frequency shifter is configured to provide an output signal based on an output from the time-domain tempo adjuster.

36. The hearing device of claim 28, wherein the frequency shifter is configured to provide an output signal based on an output from the time-domain resampler.

37. The hearing device of claim 28, wherein the frequency shifter comprises a Hilbert transform module; and wherein the processing unit further includes a phase rotation module.

38. The hearing device of claim 28, wherein the band splitter and the frequency shifter are configured to perform signal processing for frequency mapping in a time domain.

39. The hearing device of claim 28, wherein the band splitter is configured to provide a first output in the first channel for processing to achieve the first frequency mapping, and a second output in a second channel for processing to achieve a second frequency mapping.

40. The hearing device of claim 28, wherein the band splitter is configured to provide a first output for processing in the first channel, a second output for processing in a second channel, and a third output for processing in a third channel.

41. The hearing device of claim 28, wherein the microphone, the processing unit, and the receiver are parts of a behind-the-ear (BTE) hearing aid, an in-the-ear (ITE) hearing aid, an in-the-canal (ITC) hearing aid, or a binaural hearing aid system.

42. A hearing device comprising:

a microphone for reception of sound and conversion of the received sound into a corresponding first audio signal;

a processing unit for providing a second audio signal compensating a hearing loss of a user of the hearing device based on the first audio signal; and a receiver for providing an output sound signal based on the second audio signal;

wherein the processing unit comprises a band splitter, and a frequency shifter, and wherein the frequency shifter is arranged in a first channel;

wherein the processing unit also comprises a time-domain resampler configured to provide up-sampling using pole(s) and zero(s); and wherein the hearing device also comprises a time-domain tempo adjuster coupled directly or indirectly to the time-domain resampler.

43. The hearing device of claim 42, wherein the time-domain resampler is a part of a pitch shifter, and the hearing device comprises the pitch shifter.

44. The hearing device of claim 42, wherein the time-domain resampler is coupled between the band splitter and the time-domain tempo adjuster.

45. The hearing device of claim 42, wherein the time-domain tempo adjuster is coupled between the band splitter and the time-domain resampler.

46. The hearing device of claim 42, wherein the frequency shifter comprises a Hilbert transform module for performing a Hilbert transform.

47. The hearing device of claim 42, wherein the frequency shifter comprises an amplitude modulator and one or more filters coupled to the amplitude modulator.

48. The hearing device of claim 42, wherein the frequency shifter is configured to provide frequency shifting by an amount that is for only a subset of frequencies associated with the first audio signal.

49. The hearing device of claim 42, wherein the frequency shifter is configured to provide an output signal based on an output from the time-domain tempo adjuster.

50. The hearing device of claim 42, wherein the frequency shifter is configured to provide an output signal based on an output from the time-domain resampler.

51. The hearing device of claim 42, wherein the frequency shifter comprises a Hilbert transform module; and wherein the processing unit further includes a phase rotation module.

52. The hearing device of claim 42, wherein the band splitter and the frequency shifter are configured to perform signal processing for frequency mapping in a time domain.

53. The hearing device of claim 42, wherein the band splitter is configured to provide a first output in the first channel for processing to achieve the first frequency mapping, and a second output in a second channel for processing to achieve a second frequency mapping.

54. The hearing device of claim 42, wherein the band splitter is configured to provide a first output for processing in the first channel, a second output for processing in a second channel, and a third output for processing in a third channel.

55. The hearing device of claim 42, wherein the microphone, the processing unit, and the receiver are parts of a behind-the-ear (BTE) hearing aid, an in-the-ear (ITE) hearing aid, an in-the-canal (ITC) hearing aid, or a binaural hearing aid system.

* * * * *